US005562852A

United States Patent [19]

Tada et al.

[11] Patent Number: 5,562,852

[45] Date of Patent: Oct. 8, 1996

[54] RESIN MAGNETIC COMPOUND AND MOLDED ARTICLE THEREOF

[75] Inventors: Masahito Tada; Keiichiro Suzuki, both of Fukushima, Japan

[73] Assignee: Kureha Kagaku Kogyo Kabushiki Kaisha, Tokyo, Japan

[21] Appl. No.: 270,420

[22] Filed: Jul. 5, 1994

Related U.S. Application Data

[63] Continuation-in-part of Ser. No. 76,794, Jul. 5, 1994, abandoned.

[30] Foreign Application Priority Data

Jun. 15, 1992 [JP] Japan ..... 4-178835
Oct. 26, 1992 [JP] Japan ..... 4-310955

[51] Int. Cl.[6] ..... H01F 1/00; H01F 1/26

[52] U.S. Cl. ..... 252/62.54; 252/62.57; 252/62.63; 148/100; 148/105

[58] Field of Search ..... 252/62.54, 62.55, 252/62.56, 62.57, 62.63; 148/101, 100, 105; 106/287.13, 287.14

[56] References Cited

U.S. PATENT DOCUMENTS

| | | | |
|---|---|---|---|
| 4,782,195 | 11/1988 | Blackwell et al. | 264/272.17 |
| 4,994,514 | 2/1991 | Blackwell et al. | 524/262 |
| 5,256,326 | 10/1993 | Kawato et al. | 252/62.54 |

FOREIGN PATENT DOCUMENTS

| | | |
|---|---|---|
| 0485644 | 5/1992 | European Pat. Off. . |
| 57-70157 | 4/1982 | Japan . |
| 57-51860 | 11/1982 | Japan . |
| 61-95068 | 5/1986 | Japan . |
| 62-176103 | 8/1987 | Japan . |
| 4-44304 | 2/1992 | Japan . |

*Primary Examiner*—Prince Willis, Jr.
*Assistant Examiner*—Alan D. Diamond
*Attorney, Agent, or Firm*—Sughrue, Mion, Zinn, Macpeak & Seas

[57] ABSTRACT

A resin magnetic compound is disclosed, comprising (i) from 65 to 77% by weight of a magnetic powder having been surface treated with from 0.01 to 5% by weight, based on the magnetic powder, of a mercaptosilane represented by the following formula (I) or a hydrolysis product of the mercaptosilane:

$$(RO)_nR'_{(3-n)}SiR''SH \quad (I)$$

wherein R and R' each represents an alkyl group having 1 or 2 carbon atoms; R" represents an alkylene group having from 2 to 6 carbon atoms; and n represents 2 or 3, (ii) from 14 to 30% by weight of polyphenylene sulfide resin, and (iii) from 9 to 21% by weight of glass fiber. The resin magnetic compound and a molded article obtained from the compound are excellent in thermal shock resistance, magnetic characteristics, and heat resistance.

6 Claims, No Drawings

RESIN MAGNETIC COMPOUND AND MOLDED ARTICLE THEREOF

This is a Continuation-in-Part of application Ser. No. 08/076,794, filed Jul. 5, 1994, now abandoned.

FIELD OF THE INVENTION

This invention relates to a resin magnetic compound comprising a polyphenylene sulfide resin as a binder and a molded article thereof with high thermal shock resistance and excellent magnetic force.

BACKGROUND OF THE INVENTION

A compound comprising a polyphenylene sulfide resin and a magnetic powder reflects the characteristics essential to polyphenylene sulfide resin, such as heat resistance, chemical resistance, and low water absorption, and has been increasing its importance in the fields of automobiles, electric and electronic parts, and industrial machinery. The outstanding problem associated with molded articles obtained from the polyphenylene sulfide resin/magnetic powder compound consists in unsatisfactory resistance to thermal shock, i.e., the molded articles suffer from cracking with drastic changes in temperature.

Thermal shock resistance of the compound may be improved by incorporation of glass fiber as described in JP-A-62-176103 and JP-A-4-44304 (the term "JP-A" as used herein means an "unexamined published Japanese patent application"). However, addition of glass fiber in an amount sufficient for obtaining an appreciably improved thermal shock resistance interferes with dispersion of a magnetic powder and extremely deteriorates fluidity of the compound, resulting in a reduction of magnetic force.

SUMMARY OF THE INVENTION

An object of the present invention is to provide a resin magnetic compound which, even when compounded with a larger proportion of glass fiber than in conventional techniques, provides a high thermal shock resistant molded article without being accompanied with a reduction in magnetic force.

Another object of the present invention is to provide a molded article obtained from such a resin magnetic compound.

The present invention provides a resin magnetic compound comprising (i) from 65 to 77% by weight of a magnetic powder having been subjected to a surface treatment with from 0.01 to 5% by weight, based on the magnetic powder, of a mercaptosilane represented by the following formula (I) or a hydrolysis product of the mercaptosilane:

$$(RO)_nR'_{(3-n)}SiR''SH \qquad (I)$$

wherein R and R' each represents an alkyl group having 1 or 2 carbon atoms; R" represents an alkylene group having from 2 to 6 carbon atoms; and n is an integer of 2 or 3;

(ii) from 14 to 30% by weight of polyphenylene sulfide resin;

(iii) from 9 to 21% by weight of glass fiber wherein the resin magnetic compound is prepared by dry blending and melt-kneading the magnetic powder, the polyphenylene sulfide resin and the glass fiber.

Further, the present invention provides a molded article obtained from the resin magnetic compound.

DETAILED DESCRIPTION OF THE INVENTION

The magnetic powder which can be used in the present invention is a magnetic powder having been subjected to a surface treatment with a specific mercaptosilane represented by formula (I) or a hydrolysis product of the mercaptosilane.

In formula (I), examples of R and R' include methyl and ethyl groups, and examples of R" include ethylene, propylene and trimethylene groups.

The mercaptosilane represented by formula (I) preferably includes 3-mercaptopropylmethyldimethoxysilane, 3-mercaptopropylmethyldiethoxysilane, 3-mercaptopropyltrimethoxysilane, and 3-mercaptopropyltriethoxysilane. More preferred are 3-mercaptopropylmethyldimethoxysilane and 3-mercaptopropylmethyldiethoxysilane.

The mercaptosilane or the hydrolysis product thereof is used in an amount of 0.01 to 5% by weight, preferably 0.5 to 2% by weight, based on the magnetic powder. If the amount of mercaptosilane is less than 0.01% by weight, the fluidity of the resin is markedly reduced, causing a reduction in magnetic force. If it is more than 5% by weight, foaming will occur on molding.

The method of surface treatment with the mercaptosilane or the hydrolysis product thereof is not particularly restricted. The treatment is preferably carried out by agitating a magnetic powder in an alcoholic aqueous solution (e.g., methyl alcohol, ethyl alcohol, isopropyl alcohol) of a mercaptosilane or a mercaptosilane aqueous solution adjusted to a pH of 3 to 7, preferably 4.5 to 5, followed by drying.

In case of using 3-mercaptopropylmethyldimethoxysilane or 3-mercaptopropylmethyldiethoxysilane, there is no need to conduct hydrolysis beforehand, and there is obtained a compound excellent in mechanical strength and fluidity by simply mixing with polyphenylene sulfide resin, a magnetic powder, and glass fiber.

The magnetic powder to be treated is not particularly limited but preferably includes magneto-plumbite type ferrites such as barium ferrite and strontium ferrite, and rare earth magnetic powders such as samarium-cobalt alloy magnetic powder and neodymium-iron-boron magnetic powder.

The compound of the present invention contains from 65 to 77% by weight, preferably from 67 to 76% by weight, and more preferably from 68 to 74% by weight, of the magnetic powder. If the amount of the magnetic powder is less than 65% by weight, the magnetic characteristics of the resulting molded article are reduced. If it is more than 77% by weight, fluidity of the compound on molding is reduced.

The compound of the present invention contains from 14 to 30% by weight, preferably from 15 to 28% by weight, and more preferably from 16 to 26% by weight, of polyphenylene sulfide resin. If the amount of polyphenylene sulfide resin is less than 14% by weight, the fluidity of the compound is reduced to make molding difficult. If it is more than 30% by weight, the resulting molded article cannot possess sufficient magnetic characteristics.

Polyphenylene sulfide resin which can be used in the present invention as a binder includes both homopolymers comprising a p-phenylene sulfide unit and copolymers mainly comprising a p-phenylene sulfide unit. Polyphenylene sulfide resin copolymer preferably contains 60% by weight or more, and more preferably contains 90% by weight or more, of a p-phenylene sulfide unit.

Of polyphenylene sulfide resin, those substantially having a linear structure which are obtained from monomers mainly comprising bifunctional monomers are particularly preferred because of their excellent toughness. Partially crosslinked polyphenylene sulfide resins or polyphenylene sulfide resins having the melt viscosity increased by oxidative crosslinking (i.e., curing) may be employed as far as the mechanical characteristics of polyphenylene sulfide resin are retained.

The melt viscosity of polyphenylene sulfide resin is not particularly limited as long as polyphenylene sulfide resin may be stably melt-kneaded with a magnetic powder to provide a compound applicable to melt processing, such as melt extrusion or injection molding. The melt viscosity of polyphenylene sulfide resin measured at 310° C. and 200 $sec^{-1}$ is preferably from 15 to 500 Pa.s, more preferably from 20 to 400 Pa.s.

Glass fiber which can be used in the present invention usually has a diameter of 6 to 13 μm. The compound of the present invention contains from 9 to 21% by weight, preferably from 10 to 18% by weight, and more preferably from 11 to 16% by weight, of glass fiber. If the amount of glass fiber is less than 9% by weight, the resulting molded article has insufficient thermal shock resistance and reduced heat resistance. If it is more than 21% by weight, the fluidity of the compound is reduced, and the magnetic characteristics of the resulting molded article are reduced.

The resin magnetic compound is prepared by dry blending and melt-kneading the magnetic powder which has been subjected to surface treatment with the mercaptosilane, along with the polyphenylene sulfide resin, and the glass fiber.

The present invention will now be illustrated in greater detail with reference to Examples, but it should be understood that the present invention is not construed as being limited thereto.

Physical properties of the molded articles obtained were measured according to the following methods.

1) Thermal Shock Resistance

A resin magnetic compound was molded at 150° C. into a hollow cylinder having an outer diameter of 16 mm, an inner diameter of 8 mm, and a thickness of 5 mm around a metal shaft having a diameter of 8 mm and a length of 20 mm to prepare a specimen for a thermal shock test. Ten specimens per sample were immersed in a liquid phase and subjected to 500 thermal cycles, one cycle comprising −65° C. for 5 minutes and then 150° C. for 5 minutes. Ten specimens were experimented, and the number of specimens which underwent cracking after 500 thermal cycles was obtained.

2) Flexural Strength

A flexural strength of a rectangular parallelopiped specimen (3 mm×13 mm×130 mm) was measured according to ASTM D-790.

3) Maximum Energy Product

A maximum energy product of a molded article was measured according to JIS C2501.

EXAMPLE 1

3-Mercaptopropyltrimethoxysilane was mixed with an equal portion of water and a double portion of methyl alcohol to hydrolyze the mercaptosilane. Strontium ferrite powder ("NP-20" produced by Nippon Bengara Kogyo Co., Ltd.) in an amount 100 times as much as the mercaptosilane was put in a 20 l Henschel mixer, and the hydrolyzed mercaptosilane was added thereto while stirring.

In a 20 l Henschel mixer were mixed 2.4 kg of linear polyphenylene sulfide, 10.35 kg of the above-prepared silane-treated strontium ferrite, and 2.25 kg of glass fiber having a diameter of 9 μm, and the compound was fed to a twin-screw extruder having a diameter of 45 mm to prepare specimens for measurement of physical properties. The results of measurements are shown in Table 1 below.

EXAMPLE 2

The same procedure as in Example 1 was repeated, except for changing the amounts of strontium ferrite and glass fiber to 10.95 kg and 1.65 kg, respectively. The results of measurements are shown in Table 1 below.

EXAMPLE 3

The same procedure as in Example 1 was repeated, except for changing the amounts of linear polyphenylene sulfide, strontium ferrite, and glass fiber to 3.0 kg, 10.35 kg, and 1.65 kg, respectively. The results of measurements are shown in Table 1 below.

EXAMPLE 4

In a 20 l Henschel mixer were put 2.4 kg of linear polyphenylene sulfide, 10.25 kg of strontium ferrite, and 2.25 kg of glass fiber having a diameter of 9 μm, and 100 g of 3-mercaptopropylmethyldimethoxysilane was added thereto while stirring. The resulting compound was fed to a twinscrew extruder having a diameter of 45 mm to prepare specimens. The results of measurements are shown in Table 1 below.

EXAMPLE 5

The same procedure as in Example 1 was repeated, except for replacing 3-mercaptopropyltrimethoxysilane with 3-mercaptopropylmethyldimethoxysilane. The results of measurements are shown in Table 1 below.

COMPARATIVE EXAMPLE 1

The same procedure as in Example 1 was repeated, except for changing the amounts of strontium ferrite and glass fiber to 11.85 kg and 0.75 kg, respectively. The results of measurements are shown in Table 1 below.

COMPARATIVE EXAMPLE 2

The same procedure as in Example 1 was repeated, except for changing the amounts of strontium ferrite and glass fiber to 11.4 kg and 1.2 kg, respectively. The results of measurements are shown in Table 1 below.

COMPARATIVE EXAMPLE 3

The same procedure as in Example 1 was repeated, except for changing the amounts of polyphenylene sulfide resin, strontium ferrite, and glass fiber to 5.25 kg, 8.25 kg, and 1.5 kg, respectively. The results of measurements are shown in Table 1 below.

COMPARATIVE EXAMPLE 4

The same procedure as in Example 1 was repeated, except that the magnetic powder was not treated with a mercaptosilane. The results of measurements are shown in Table 1 below.

TABLE 1

| Example No. | Compound (wt %) PPS[1] | Magnetic Powder | Glass Fiber | Mercapto-silane | Mixing Method | Flexural Strength (MPa) | Thermal Shock Resistance (Number of cracked specimens) | Maximum Energy Product (kJ/m$^3$) | Melt Viscosity[2] (10 Pa · s) |
|---|---|---|---|---|---|---|---|---|---|
| Example 1 | 16 | 69 | 15 | MPTMS[3] | A[5] | 178 | 0 | 8 | 39 |
| Example 2 | 16 | 73 | 11 | MPTMS | A | 166 | 0 | 10 | 38 |
| Example 3 | 20 | 69 | 11 | MPTMS | A | 162 | 0 | 8 | 37 |
| Example 4 | 16 | 69 | 15 | MPDMS[4] | B[6] | 186 | 0 | 8 | 29 |
| Example 5 | 16 | 69 | 15 | MPDMS | A | 183 | 0 | 8 | 32 |
| Comparative Example 1 | 16 | 79 | 5 | MPTMS | A | 146 | 10 | 11 | 39 |
| Comparative Example 2 | 16 | 76 | 8 | MPTMS | A | 157 | 2 | 10 | 38 |
| Comparative Example 3 | 35 | 55 | 10 | MPTMS | A | 155 | 0 | 2 | 31 |
| Comparative Example 4 | 16 | 69 | 15 | — | B | 142 | 10 | 7 | 59 |

Note:
[1]PPS: polyphenylene sulfide homopolymer
[2]Measured at 330° C. and 1000 sec$^{-1}$.
[3]MPTMS: 3-Mercaptopropyltrimethoxysilane
[4]MPDMS: 3-Mercaptopropylmethyldimethoxysilane
[5]A: The magnetic powder was sprayed with an alcoholic aqueous solution of the mercaptosilane, agitated, and then dried.
[6]B: The mercaptosilane (not hydrolyzed) was mechanically mixed with polyphenylene sulfide, magnetic powder, and glass fiber.

In the above examples, the practical range of the flexural strength is 147 MPa or more. The practical range of the maximum energy product is 4.8 kJ/m$^3$ or more. When the number of cracked specimens by the thermal shock test is 0 or 1, the molded article can be practical.

As is apparent from Table 1 above, the resin magnetic compound according to the present invention provides a molded article excellent in thermal shock resistance, magnetic characteristics, and heat resistance. The resin magnetic compound and molded articles thereof are applicable to parts requiring thermal shock resistance, magnetic characteristics and heat resistance, such as automobile revolution sensors, speed sensors, and position sensors of various motors.

While the invention has been described in detail and with reference to specific examples thereof, it will be apparent to one skilled in the art that various changes and modifications can be made therein without departing from the spirit and scope thereof.

What is claimed is:

1. A resin magnetic compound comprising (i) from 65 to 77% by weight of a magnetoplumbite ferrite or a rare earth magnetic powder having been subjected to a surface treatment with from 0.01 to 5% by weight, based on the magnetic powder, of a mercaptosilane represented by the following formula (I) or a hydrolysis product of the mercaptosilane:

$$(RO)_nR'_{(3-n)}\text{-}SiR''\ SH \qquad (I)$$

wherein R and R' each represents an alkyl group having 1 or 2 carbon atoms; R" represents an alkylene group having from 2 to 6 carbon atoms; and n is an integer of 2 or 3;

(ii) from 14 to 30% by weight of polyphenylene sulfide resin; and (iii) from 9 to 21% by weight of glass fiber;

wherein the resin magnetic compound is prepared by dry blending and melt-kneading the magnetic powder, the polyphenylene sulfide resin, and the glass fiber.

2. The resin magnetic compound as in claim 1, wherein the mercaptosilane is 3-mercaptopropylmethyldimethoxysilane, 3-mercaptopropylmethyldiethoxysilane, 3-mercaptopropyltrimethoxysilane or 3-mercaptopropyltriethoxysilane.

3. The resin magnetic compound as in claim 1, wherein the mercaptosilane is 3-mercaptopropylmethyldimethoxysilane or 3-mercaptopropylmethyldiethoxysilane, and wherein said magnetic powder is strontium ferrite powder.

4. A molded article obtained from a resin magnetic compound comprising (i) from 65 to 77% by weight of a magnetoplumbite type ferrite or a rare earth magnetic powder having been subjected to a surface treatment with from 0.01 to 5% by weight, based on the magnetic powder, of a mercaptosilane represented by the following formula (I) or a hydrolysis product of the mercaptosilane:

$$(RO)_nR'_{(3-n)}SiR''SH \qquad (I)$$

wherein R and R' each represents an alkyl group having 1 or 2 carbon atoms; R" represents an alkylene group having from 2 to 6 carbon atoms; and n is an integer of 2 or 3;

(ii) from 14 to 30% by weight of polyphenylene sulfide resin; and (iii) from 9 to 21% by weight of glass fiber;

wherein the resin magnetic compound is prepared by dry blending and melt-kneading the magnetic powder, the polyphenylene sulfide resin, and the glass fiber.

5. The molded article as in claim 4, wherein the mercaptosilane is 3-mercaptopropylmethyldimethoxysilane, 3-mercaptopropylmethyldiethoxysilane, 3-mercaptopropyltrimethoxysilane or 3-mercaptopropyltriethoxysilane.

6. The molded article as in claim 4, wherein the mercaptosilane is 3-mercaptopropylmethyldimethoxysilane or 3-mercaptopropylmethyldiethoxysilane, and wherein said magnetic powder is strontium ferrite powder.

* * * * *